United States Patent [19]

Lange

[11] 3,987,816

[45] Oct. 26, 1976

[54] ENTRANCE DUCT WITH WEIR

[75] Inventor: Norbert G. Lange, Sanborn, N.Y.

[73] Assignee: Hooker Chemicals & Plastics Corporation, Niagara Falls, N.Y.

[22] Filed: Dec. 30, 1975

[21] Appl. No.: 645,509

[52] U.S. Cl. ..... 137/563; 204/238; 204/DIG. 1; 137/565; 137/574; 137/576

[51] Int. Cl.[2] ..... F03B 7/07

[58] Field of Search ..... 137/563, 565, 574, 576; 29/195 R; 204/234, 235, 237, 238, 240, DIG. 1; 134/30, 40

[56] References Cited

UNITED STATES PATENTS

| | | | |
|---|---|---|---|
| 1,455,927 | 5/1923 | Morison | 137/576 |
| 2,225,498 | 12/1940 | Hollander | 137/563 |
| 2,228,503 | 6/1942 | Weaver | 204/235 |
| 2,710,832 | 6/1955 | Harr | 204/DIG. 1 |
| 3,239,438 | 3/1966 | Voorhees | 204/238 |
| 3,247,969 | 4/1966 | Miller | 137/563 |
| 3,922,208 | 11/1975 | Cordone et al. | 204/238 |

*Primary Examiner*—William R. Cline
*Assistant Examiner*—H. Jay Spiegel
*Attorney, Agent, or Firm*—Peter F. Casella; William J. Crossetta, Jr.

[57] ABSTRACT

A tank is provided in which a lower solution is covered by an upper solution which is non-miscible with the lower solution. In the operating condition the apparatus automatically uncovers a small area of lower solution by raising the level of lower solution in that area and having the upper solution pass over a weir into a holding chamber. When the operating condition ceases, the solution automatically returns to the same levels as in the static condition.

5 Claims, 3 Drawing Figures

ENTRANCE DUCT WITH WEIR

BACKGROUND OF THE INVENTION

This application relates to a multi weir tank for use with a multi-phase bath for plating of a substrate or similar type use. More particularly, it relates to a tank having entrance ducts wherein items to be exposed to lower phases of multi-phase baths may enter and exit the lower layers of the bath without coming into contact with the upper layer.

In certain preplating processes, it is useful to use a two layer bath comprising a lower layer or phase of preplating solution and an upper layer or phase of liquid which is not miscible with the lower layer. As an example, water can be used to cover the trichloroethylene/phosphorus sesquisulfide preplating solution disclosed and claimed in U.S. Pat. No. 3,650,708. The water serves the function of preventing the preplating solution from evaporating and filling the surrounding environment with fumes.

Tanks having weirs are well known in the plating art, and are used to circulate both liquids in the two-layer bath while maintaining the integrity of the two levels. One problem with such tanks holding two layer baths is that an article which is to be subjected to the lower solution must also come in contact with the surface solution. Although this is sometimes a desirable feature, in certain instances it is not.

One proposed solution to the problem of covering the lower solution while maintaining openings in the surface through which articles may pass without contacting the covering solution is the apparatus shown in FIG. 1. This apparatus basically consists of a tank 11 having a weir (as described above) and also having two tubes 15, 17 which are held in place by mechanical means (not shown) in a geometrical arrangement which approximates a V shape as shown in the drawing. Once these tubes are placed in the solution, the surface layer 31 must be removed from each tube by mechanical means. When the plating operation ceases, and it is desired to cover the lower solution 33 with the surface solution 31, the solution must either be added by mechanical means, or alternatively, the tubes may be removed.

In operation of the above-described apparatus, an article to be subjected to the lower solution enters the bath through tube 15 and exits through tube 17. In a preferred use, a pulley 41 is present at the bottom of the tank midway between the bottom end of each tube. Wire cable 35 having a plastic sheath which is to be treated is advanced over pulley 43, into tube 15, over pulley 41, out of tube 17 and over pulley 45. In this manner, most of the lower solution 33 remains covered by surface solution 31 while the cable 35 comes in contact only with the plating solution 33.

When the above-described apparatus was used in small quasi-commercial applications of an experimental nature, the disadvantages of this apparatus for large scale commercial use became apparent. One such disadvantage to a commercial operation is the labor required to manually remove the surface solution from the tubes each time the apparatus is placed in use, and replacing the surface solution each time the plating operation is discontinued. Accordingly, one of the objects of the invention is to provide a tank in which most of the plating solution is covered during plating operations while leaving uncovered a large enough portion of the plating solution to accept an article without the article contacting the surface solution. It is another object of the invention to automatically cover the entire plating solution with surface solution when the apparatus is shut down, and also to automatically uncover much of the plating solution as is desired when the apparatus is put in operation.

SUMMARY OF THE INVENTION

The above-mentioned objects of the invention are achieved by providing an apparatus for a holding a 2 phase solution having an upper phase and a lower phase in which the apparatus comprises a housing comprising at least one side wall in sealed connection to a bottom, in which at least one sidewall is provided with a pump inlet conduit opening in the lower half of the region of the lower phase. The opening is in sealed connection with conduit means which are in sealed connection with the inlet of pumping means. Weir means are provided for separating the part of the housing containing the lower phase into two parts, a pump side part in direct communication with the pump inlet conduit opening, and a non-pump side part. The weir means is provided with means for equalizing the level of each part of the lower phase when the 2 phase solution is in the static condition. The weir means is also provided with conduit means in field arrangement to an opening in the weir means, the conduit extending into the non-pump side of the part lower phase to a chamber. The chamber comprises at least one sidewall having an edge in the region of the lower phase and having another edge extending to a point above the level of the upper phase so that the upper phase cannot overflow the sidewall when the apparatus is in either the operating or static condition. Interior to the at lease one sidewall is a sub-chamber. The sub-chamber is formed by a second sidewall which has an edge in the region of the lower phase and another edge extending to a point in the region of the upper phase. The remaining two edges of the second sidewall are in sealed connection with the at least one sidewall of the housing. The bottom edge of the second sidewall of the subchamber is in sealed connection with a bottom plate which is also in sealed connection with the at least one sidewall of the housing. The bottom plate also has an opening which is in sealed connection with the conduit means. Conduit means are also provided to the outlet of the pumping means and extend to a point in the region above or in the upper phase in the non-pump side of the housing which is exterior to the chamber.

When the pump is put into operation, the solution shifts from a static phase condition in which all of the lower phase is covered by the upper phase solution to a steady state operating condition in which the area of the lower phase solution in the region between the second sidewall and at least one sidewall which is exterior to the subchamber is not covered by upper phase solution. Thus, in the operating condition, articles may be immersed in the lower phase solution without coming in contact with upper phase solution.

THE DRAWINGS

DETAILED DESCRIPTION

Figure 1:
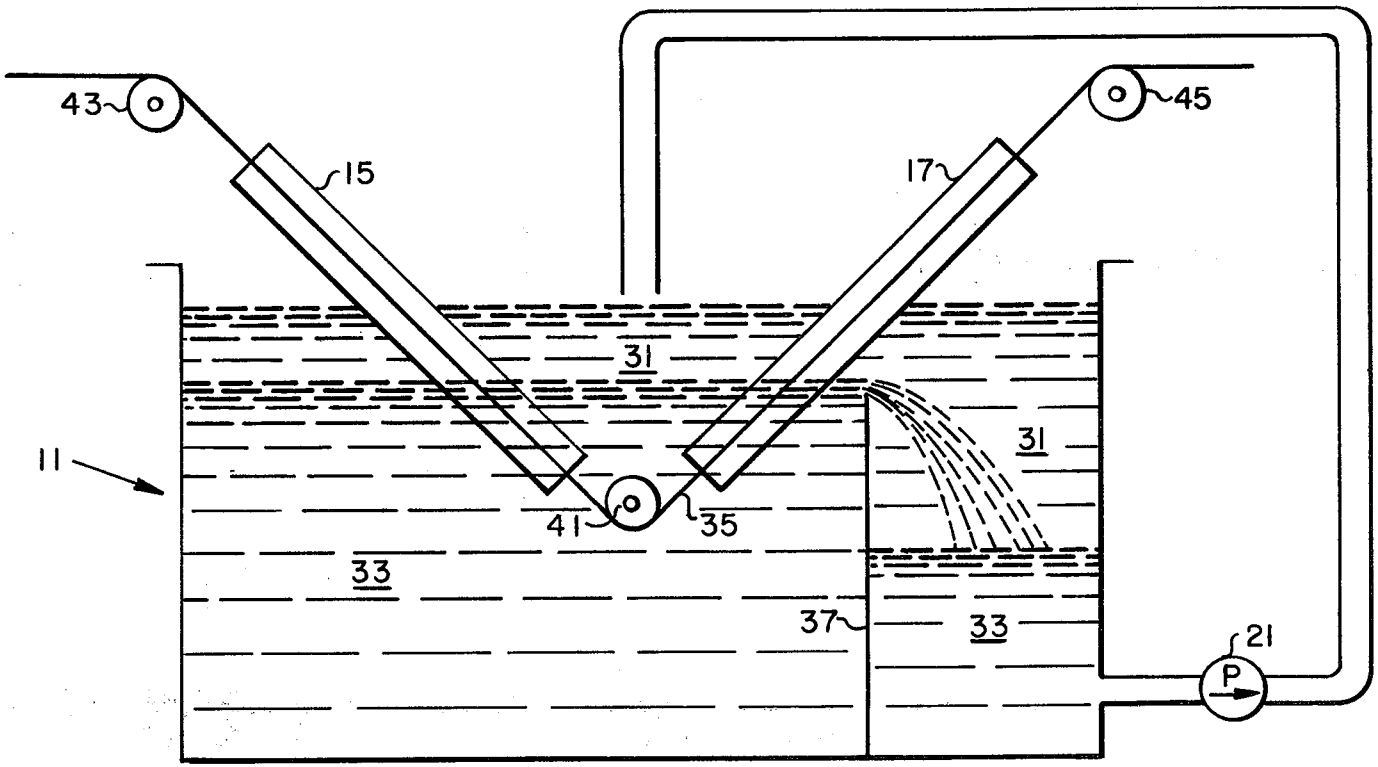
FIG. 1 is a schematic diagram of a prior art tank.
Figure 2:
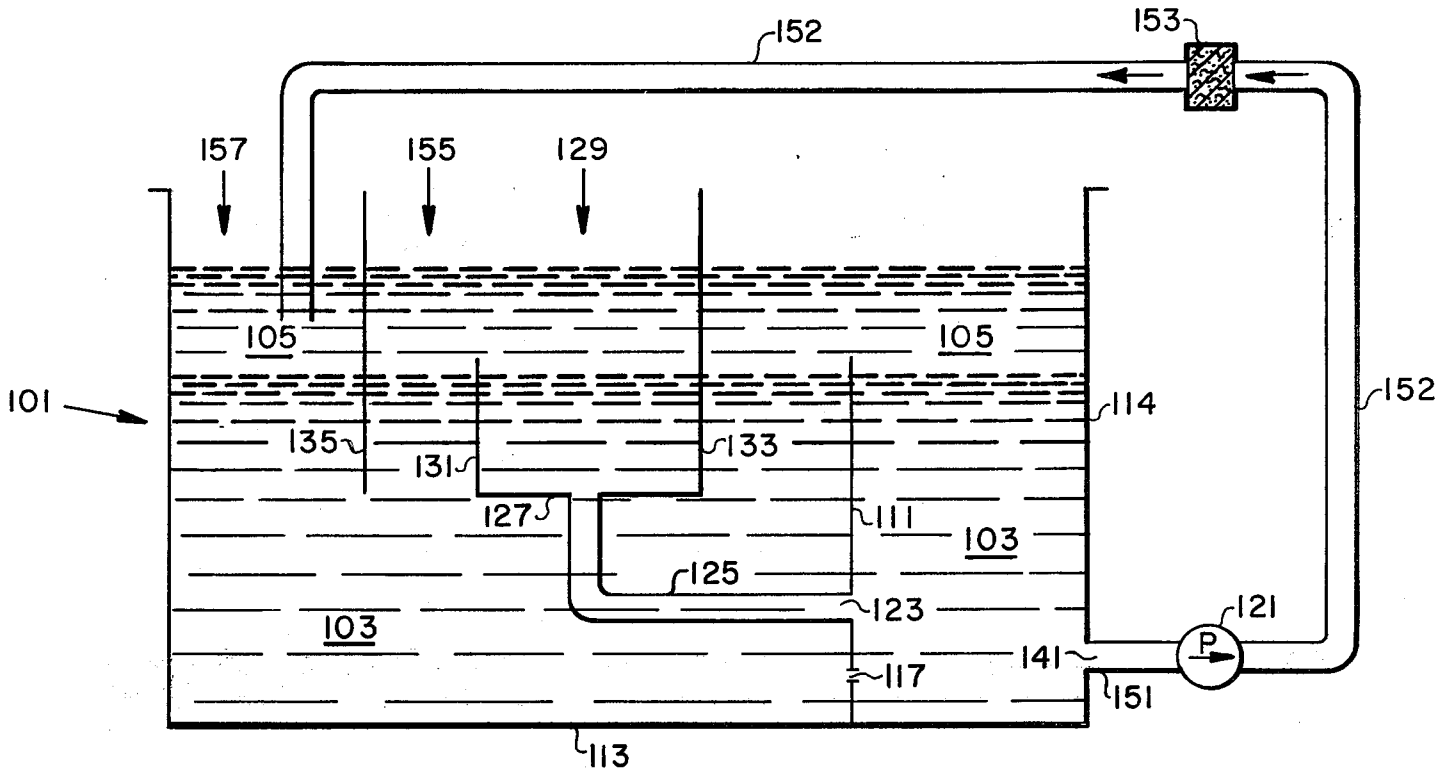
FIG. 2 is a schematic diagram of the tank of this invention when it is in the static condition.
Figure 3:
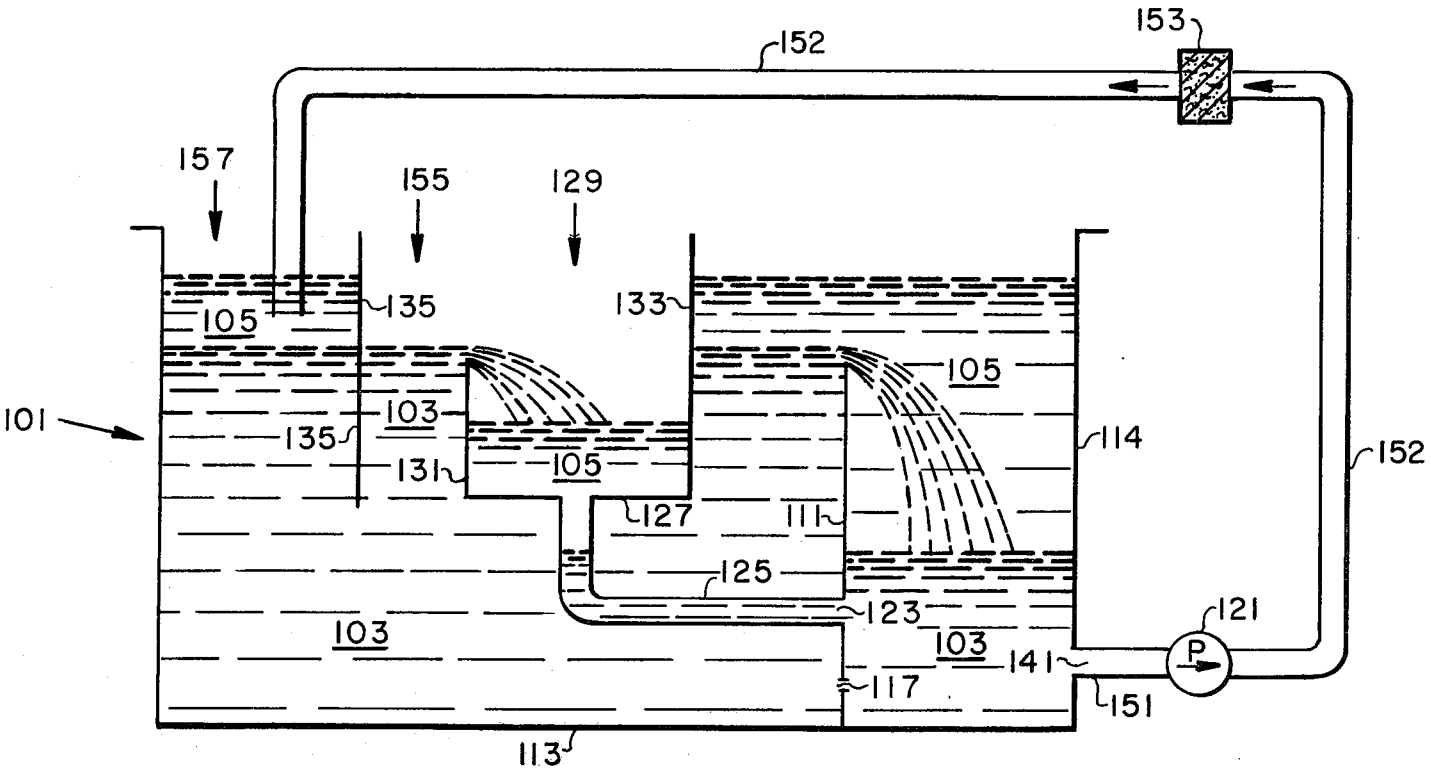
FIG. 3 is a schematic diagram of the tank of this invention when it is in the operating condition.

The apparatus of this invention, shown in the static mode in FIG. 2 and in the operating mode in FIG. 3, comprises a tank 101 having a series of weirs and ducts. Looking at FIG. 2, the tank 101 holds a two layer or phase liquid solution; the lower layer or phase 103 being the primary treating solution and the upper layer or phase 105 being the surface solution. The tank (or housing) 101 comprises a bottom 113 and at least one sidewall 114 in sealed connection with the bottom.

An opening 141, provided on the at least one sidewall 114, is connected in sealed arrangement to conduit means 151 which are in turn connected to the inlet of a circulating pump 121. The materials in the pump 121 should be compatible with the lower phase solution 103.

A main tank weir 111 is provided to separate the part of the tank containing the lower solution into two substantially non communicating parts; a pump side part and a non pump side part. The edges of the main weir are in sealed connection with the bottom 113 and the at least one sidewall 114, and the remaining edge extends to a point in the region of the upper phase 105 when the tank is in the nonoperating or static condition in which the pump has not been running for a period of time much greater than the equalizing time which is defined below.

The height of the weir will vary according to the dimensions and physical arrangement of the tank, the amount of plating solution, and the thickness of the layer of surface solution employed. On the lower portion of the main weir 111, in the region of the plating solution is an equalizing port 117, which is an opening in the weir preferably of a small size relative to the capacity of the circulating pump 121. Above the equalizing port 117 on the main weir 111, and still in the region of the plating solution is an equalizing pipe opening 123 which is connected to equalizing pipe 125 which is connected to the lower plate 127 of water chamber 129.

Water chamber 129 is formed by the small duct weir 131, lower portion 127 and the large duct weir 133. The large duct weir 133 is on the side of the water chamber 129 nearest to the main weir 111. The lower end of the large duct weir 133 extends into the region of the lower solution 103, while the upper end of the large duct weir extends above the level of the upper solution 105. The lower end of the small duct weir extends into the region of the lower solution, while the upper end extends into the upper plating solution, preferably to about the same height as the main weir 111.

The entrance duct weir 135 may be approximately of the same dimension as the large duct weir 133 and at least as high and may be oriented in about the same way, having its lower end in the lower solution and its upper end above the upper solution.

A pump 121 is provided to circulate the lower solution 103 which enters the pump through an opening 141 in the at least one sidewall 114. The lower solution is pumped through conduit means represented diagrammatically at 152 into the opening defined by tank wall 114 and entrance duct weir 135. Optionally, the lower solution may be passed through a filter 153 located along the conduit 152.

The operating condition of the tank is shown diagramatically in FIG. 3. When the pump 121 is placed in operation, the level of the lower solution 103 on the pump suction side of tank weir 111 is lowered. At the same time, the level of the lower solution on the other side of the tank weir 111 is raised to the top of the tank weir 111 and then begins to overflow the tank weir, except in the area of the water chamber 129. Due to the suction of the pump 121 which acts through the equalizing pipe 125, the lower solution level in the chamber 129 and pipe 125 drops to a level which approximately equals the lower solution level on the pump side of the main tank weir 111.

The item entrance and exit duct area 155 is defined by small duct weir 131 and entrance duct weir 135. As the lower solution 103, is raised in this area by the pump 121, the water flows out of the item entrance and exit area 155 and overflows into the water chamber 129. Eventually, all of the water from the item entrance and exit area will have overflowed into the water chamber 129. And, when a steady state operating condition is reached, lower solution 103 will overflow into the water chamber 129. Due to the placement and size of entrance duct weir 135, no water will overflow from the lower solution input area 157 into the item entrance and exit area 155. Thus, in the steady state operation of the tank, all of the lower solution 103 will be covered with upper solution 105 with the exception of item entrance and exit area 155. In this manner, items to be treated can enter and exit the lower solution 103 without coming into contact with the upper solution 105.

When it is desired to discontinue the operation of the system, the flow of lower solution 103 is discontinued (i.e. the pump is shut off) and the lower and upper solution levels will return to the static condition shown in FIG. 2. This is accomplished by flow of the lower solution through the equalizing port 117 and equalizing line 123 until the levels of lower solution on each side of the main tank weir 111 is approximately equal. The time required for the return to the static condition is defined as the equalizing time. This time will be dependent on the size of ports 117 and 123.

In a preferred embodiment the pump opening 141 is located such that two conditions are independently satisfied. First, at least one sidewall 114 is at or below the minimum level of lower solution in the water chamber which will allow complete water removal from item entrance and exit area 155. Second, the opening 141 is below the disengaging area of the lower solution 103 overflow on the pump side of main weir 111. The disengaging area is defined as the area of entrainment caused by the overflow of lower solution over main weir 111 in which there may be some mixing of upper solution 105 and lower solution 103.

Other conditions satisfied in a preferred embodiment are that the upper edge of weir 133 and weir 135 are high enough so that no upper solution 105 will overflow the edges of said weirs when the apparatus is in the operating condition.

Useful considerations in adapting the apparatus of this invention to specific uses are the volume of item entrance and exit area 155; the depth of the upper solution 105; the size and capacity of the pump 121; and the size and capacity of pipe 125. If the volume of area 155 is known, then the desired area of the water chamber 129 may easily be calculated. The size of pipe 125 should preferably be on the order of the capacity of the pump opening 141 to allow for even flow of the solution when the pump is in operation. The equalizing port 117 is much smaller than pump opening 141, and can be for example about one-eighth as large.

Although particular examples of the operation and construction of the novel plating tank of this invention have been given, the invention is not so limited. It encompasses all equivalent variants and is limited only by the claims.

I claim:

1. An apparatus for holding a two phase solution having an upper phase and a lower phase comprising:

a housing comprising at least one sidewall and a bottom;

at least one sidewall provided with a pump inlet conduit opening in the lower half of the region of the lower phase, the opening sealingly secured to conduit means, the conduit means sealingly secured to the inlet of pumping means;

weir means for separating the part of the housing containing the lower phase into two parts, a pump-side part in direct communication with the pump inlet conduit opening, and a non-pump-side part, the weir means also provided with means for equalizing the level of each part of the lower phase when the two phase solution is in the static condition;

conduit means sealingly secured to an opening in the weir means and extending into the non-pump-side part of the lower phase, to a chamber, the chamber comprising, a bottom plate having at least one edge having an opening which is sealingly secured to the conduit means, first weir means sealingly secured to the at least one edge of the bottom plate and extending to a point above the level of the upper phase so that no overflow will occur in either the static or operating condition, second weir means sealingly secured to the at least one edge of the bottom plate and extending to a point in the region of the upper phase when the two phase solution is in the static condition, the second weir means substantially opposite the first weir means, enclosure means for sealingly connecting the first weir means and second weir means with a third weir means, the third weir means having a lower edge in the region of the lower phase and extending to a point above the level of the upper phase so that no overflow will occur in either the static or operating condition, said third weir means located substantially opposite of the second weir means from said first weir means, the means for sealingly connecting the first weir means, second weir means and third means extending from at least the bottom edge of each of said weir means to at least the upper edge of each of said weir means to form a sealed sub-chamber consisting of the bottom plate, first weir means, second weir means and enclosure means;

conduit means sealingly secured to the outlet of said pumping means and extending to a point in the region on the opposite side of said third weir means from said second weir means.

2. The apparatus of claim 1 wherein the housing is a tank having a bottom and four sidewalls.

3. The apparatus of claim 2 wherein the weir means for separating the lower phase into two parts is in sealed arrangement with the bottom and two opposite sidewalls to form two compartments in the tank.

4. The apparatus of claim 3 in which the chamber comprises a substantially rectangular bottom plate having four edges, two opposing edges in sealed arrangement with the two opposite sidewalls of the tank to which the weir means is in sealed arrangement, first weir means having four edges, one edge in sealed arrangement with the edge of the bottom plate which faces the weir means, the first weir means also having two edges in sealed arrangement with each of the opposite sidewalls to which the weir means is in sealed arrangement, the remaining edge of the first weir means extending to a point above the level of the upper phase, second weir means having four edges, one edge in sealed arrangement with edge of the bottom plate opposite the edge which is in sealed arrangement with the first weir means, the opposite edge of the second weir means extending to a point in the region of the upper phase, the remaining edges in sealed arrangement with the sidewalls to which the weir means are in sealed arrangement, third weir means having four edges, one edge disposed in the region of the lower phase, the opposite edge at a point above the upper phase, the remaining edges in sealed arrangement with the sidewalls to which the weir means are in sealed arrangement.

5. The apparatus of claim 1 wherein the means for equalizing the level of each part of the lower phase comprises an equalizing part in the weir means allowing communication between the two parts, the equalizing part being substantially smaller than the pump inlet conduit opening so that when the pump is operating, the flow through the equalizing port will be insignificant with respect to the flow through the pump.

* * * * *